United States Patent [19]

Sperry

[11] 4,228,653

[45] Oct. 21, 1980

[54] ENGINE CYLINDER EXHAUST PORT

[75] Inventor: Kenneth D. Sperry, Fraser, Mich.

[73] Assignee: General Motors Corporation, Detroit, Mich.

[21] Appl. No.: 21,840

[22] Filed: Mar. 19, 1979

[51] Int. Cl.[3] ..... F02F 1/42

[52] U.S. Cl. ..... 60/272; 123/188 M; 123/193 H

[58] Field of Search ..... 60/272; 123/193 H, 188 M

[56] References Cited

U.S. PATENT DOCUMENTS

| | | | |
|---|---|---|---|
| 2,578,932 | 12/1951 | Hinze | 60/272 |
| 3,273,551 | 9/1966 | Julien | 123/188 M |
| 3,507,261 | 4/1970 | Myers | 123/188 M |
| 3,557,766 | 1/1971 | Stark | 123/191 |

FOREIGN PATENT DOCUMENTS

| | | | |
|---|---|---|---|
| 324404 | 11/1976 | U.S.S.R. | 123/188 M |

*Primary Examiner*—Douglas Hart

*Attorney, Agent, or Firm*—Robert J. Outland

[57] ABSTRACT

Airflow through a sharply curved engine cylinder exhaust port is increased by the provision of a flow guide comprising a smoothly curved free standing bump on the floor of the port's exit portion rising smoothly upward from a sharply curved wall portion near the throat and then declining smoothly into the floor of the exit portion. The bump is configured to reduce turbulence in the fast flowing central mass of exhaust gases flowing through the port while providing increased laminar flow area for gases to flow along the port wall surfaces.

2 Claims, 8 Drawing Figures

ENGINE CYLINDER EXHAUST PORT

TECHNICAL FIELD

This invention relates to internal combustion engines and, more particularly, to configurations of engine cylinder exhaust ports for conducting exhaust gases from the cylinders of such engines.

BACKGROUND OF THE INVENTION

It is common in the design of internal combustion engines to provide for each cylinder an exhaust port that opens through the closed end of the respective cylinder and is controlled by a poppet exhaust valve. The port provides a passageway through which exhaust gases are conducted from the cylinder after combustion therein for disposal by the engine exhaust system.

The exhaust port and its associated poppet valve are generally made as large and as curve free as possible in order to provide a smooth and relatively restriction free path for passage of the exhaust gases out of the cylinder when the exhaust valve is opened. In actual practice, it is, of course, necessary to limit the size and location of both the exhaust valves and their respective exhaust ports in a manner that best meets all the various design requirements relating to the engine construction. Thus, it is often the case that the exhaust port will be designed with a relatively sharp angular bend connecting a throat portion near the valve seat with an exit portion extending laterally out through a side wall of the port defining cylinder or engine block.

SUMMARY OF THE INVENTION

In the inventor's United States patent application Ser. No. 879,892, filed Feb. 21, 1978 and assigned to the assignee of the present invention, now U.S. Pat. No. 4,159,011 there is disclosed an engine cylinder inlet port arrangement wherein a flow deflector in the form of the free standing bump on the floor of the entrance portion of the port is utilized to improve the efficiency of gas flow through the port into the engine cylinder.

The present invention provides a modified and improved exhaust port configuration applicable to sharply angled engine exhaust ports. In this configuration, a free standing bump somewhat similar in appearance to the flow deflector of the above mentioned inlet port arrangement is positioned in a somewhat different manner in a sharply curved exhaust port. The bump acts as a flow guide to reduce turbulence in the exhaust gases passing around the inner portion of the curve, thereby increasing the flow efficiency of the port and permitting scavenging of the cylinder with a lower overall pressure differential.

In exhaust port arrangements according to this invention, the free standing bump rises from the sharply curved portion of the port wall smoothly upward in the direction of gas flow toward the opposite port wall to a height which may approximate about one-third of the port height. The bump is then curved smoothly downward and faired into the exit portion of the port wall downstream of the sharply curved portion.

These and other features and advantages of the invention will be more fully understood from the following description of a specific embodiment taken together with the accompanying drawings.

BEST MODE FOR CARRYING OUT THE INVENTION

Figure 1:
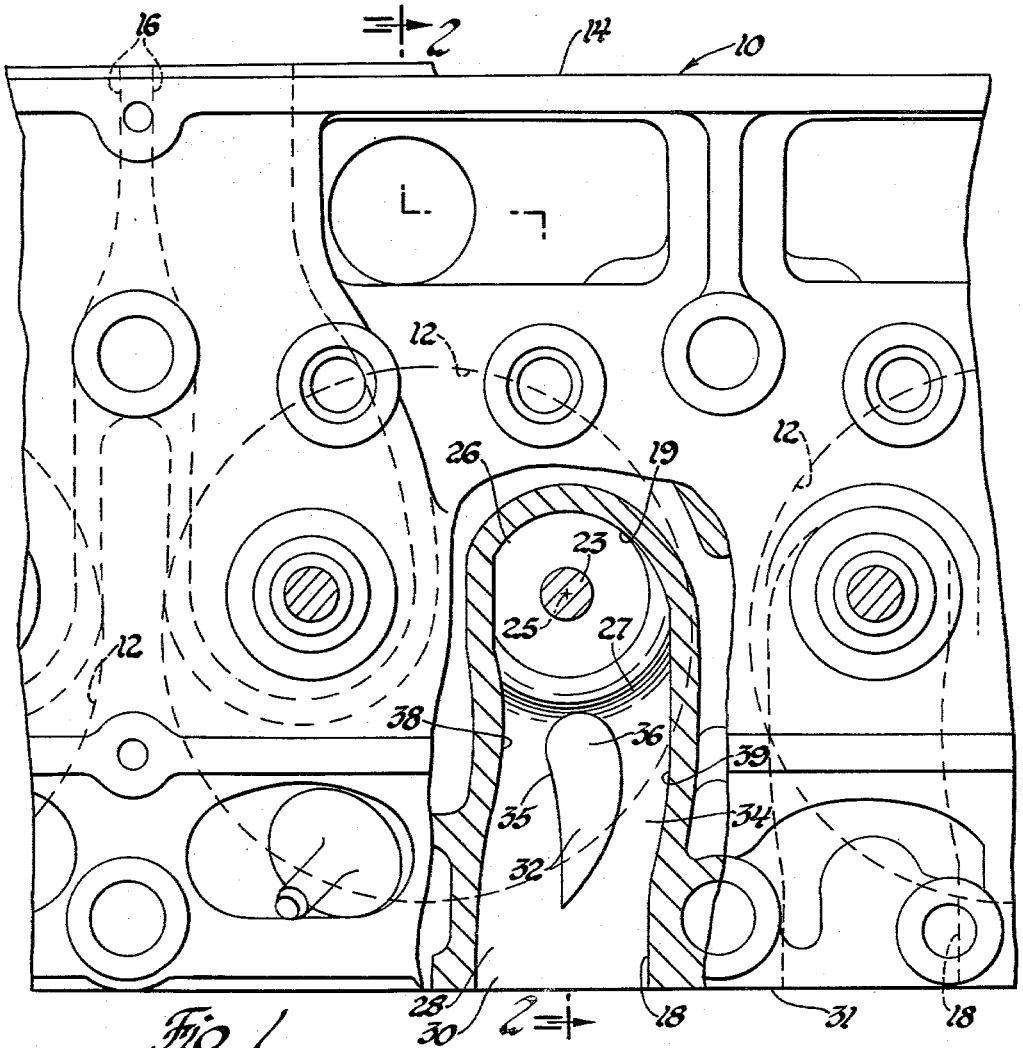
FIG. 1 is a fragmentary top view of an engine showing the cylinder head with a portion broken away to show the configuration of a cylinder exhaust port provided with a flow guide in accordance with the present invention.
Figure 2:
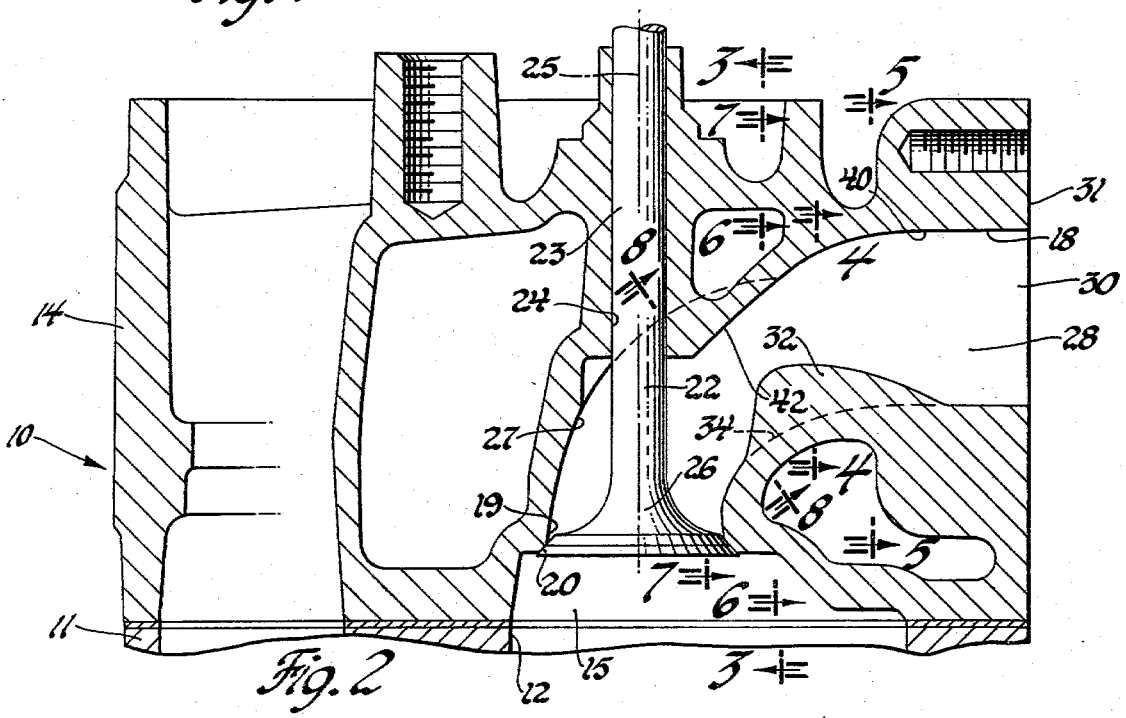
FIG. 2 is a cross-sectional view taken generally in the plane of the line 2—2 of FIG. 1 and illustrating the configuration of the exhaust port and its associated engine combustion chamber.
Figure 3:
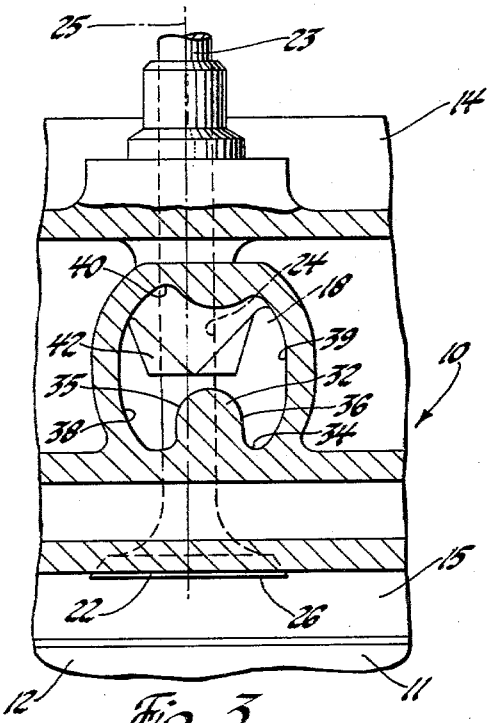
FIG. 3 is a fragmentary cross-sectional view as seen from the plane of the line 3—3 of FIG. 2 and illustrating the configuration of the port and flow guide.
Figure 4:
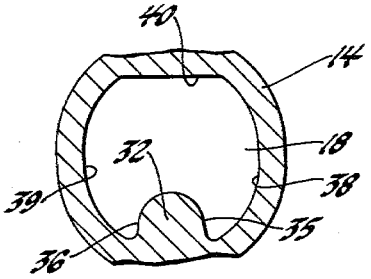
FIGS. 4 through 8 are cross-sectional views as seen from the planes indicated by the lines 4—4, 5—5, 6—6, 7—7 and 8—8, respectively, of FIG. 2 and further illustrating the port and flow guide configurations.
Figure 5:
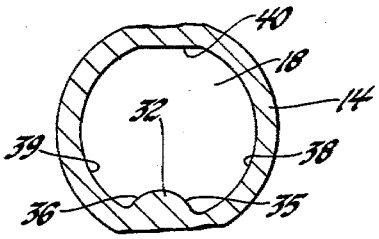
Figure 6:
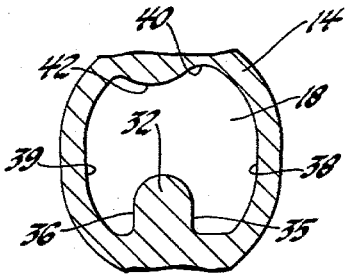
Figure 7:
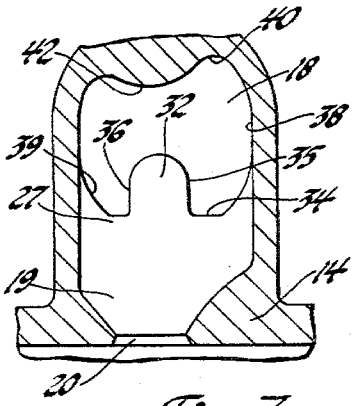
Figure 8:
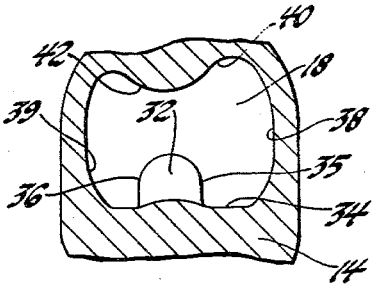

Referring now to the drawings in detail, there is shown an internal combustion engine generally indicated by numeral 10 and including a block 11 defining a plurality of cylinders 12 closed by a cylinder head 14 having combustion chamber recesses 15 at the cylinder ends. Each recess 15 is connected with a valve controlled inlet port 16 extending through the cylinder head for the purpose of admitting air or combustible mixture into its respective cylinder.

An exhaust port 18 is connected with each recess adjacent its respective inlet port by a circular throat 19 terminating in a valve seat 20. Each exhaust port is provided with an exhaust valve 22 having a stem 23 carried for reciprocation in a valve guide 24 formed as part of the cylinder head and having an axis 25 aligned with the respective port throat 19 and valve seat 20. Each valve also includes a head 26 which is seatable on the valve seat 20 so as to close the exhaust port against the passage of gas therethrough from the engine cylinder, but which, upon downward movement of the exhaust valve in its guide, opens an annular passage between the valve head and seat permitting the passage of exhaust gases into the exhaust port.

The exhaust port extends from the throat 19 through a sharply curved connecting portion 27 to an exit portion 28 that extends laterally at a sharp angle with the axis of the valve stem to an opening 30 in one side 31 of the cylinder head.

In the normal operation of internal combustion engines, the exhaust valves are opened during periods when substantial residual pressure still resides in the respective engine cylinders. This pressure causes an initial outflow of gas through the widening annular orifice formed by the opening of each valve. The gas outflow proceeds initially at a very high rate and then moderates to a somewhat lower rate as further exhaust gases are forced out of the exhaust port upon upward motion of the engine piston (not shown) in the common four-stroke cycle method of operation. In the case of sharply curved exhaust ports of the type described, the rapid outflow of exhaust gas through the port may cause a turbulent breaking away of gas flow from convexly curved inner portion of the sharply curved port wall, creating a turbulent condition that interferes with gas flow and reduces the ability of the port to discharge the exhaust gases at a reasonable pressure restriction level.

In the disclosed arrangement, the tendency for turbulence to occur in the port is substantially reduced by the provision of a flow guide in the form of a free standing bump 32 formed on the port wall. The bump extends nearly tangentially inwardly toward the center of the port from the sharply curved convex wall or floor portion 34 of the port. Sides 35, 36 of the bump extend upwardly from the floor and are spaced from the adjacent sides 38, 39 of the port.

Considered in the direction of gas flow through the port, the bump begins at a point on the sharply curved wall 34 near the throat and extends generally upwardly away from the cylinder toward the roof 40 of the port opposite the sharply curved wall beyond the position of the valve guide 24 and near the end of the faired protrusion 42 in the roof of the port. The bump extends into the port center to a height of about one-third of the total port height, although the preferred height of the bump may be varied in accordance with the needs of the particular engine and port configuration. Near its peak, the bump is smoothly rounded and curves through approximately a right angle toward the exit portion of the port, extending thereinto and being smoothly blended or faired into the port floor at a point beyond the sharply curved wall and well into the exit portion.

In the particular port disclosed, the centerline of the passage defined by the port varies slightly from the lateral plane through the center of the exhaust valve and port throat. For this reason, the configuration of the flow guide bump is nonsymmetrical, being varied somewhat as determined by flow tests to provide the best overall reduction of flow restrictions.

In operation, rapidly flowing exhaust gas in the central portion of the port is deflected upwardly at the sharply curved wall portion where it is turned in the direction of the port exit portion in a manner that avoids turbulent separation from the port wall. Concurrently, the slower flowing gas near the port walls is directed between the bump and the sides of the port which together provide an increased area for laminar flow of gas therealong. Thus, the total body of exhaust gas is passed through the sharply curved wall portion of the port with a reduction in turbulence and a resultant increase in the flow efficiency of the port.

While the invention has been described by reference to a particular embodiment chosen for purposes of illustration, it should be understood that numerous changes could be made without departing from the spirit and scope of the inventive concepts disclosed. Thus, it is intended that the invention not be limited to the specific features of the disclosed embodiment, but that it have the full scope permitted by the language of the following claims.

The embodiments of the invention in which an exclusive property or privilege is claimed are defined as follows:

1. An internal combustion engine including means defining a cylinder closed at one end, an exhaust port communicating with the cylinder through said closed end and a poppet exhaust valve disposed in the port and having head and stem portions reciprocable on an axis for controlling communication of the exhaust port with the cylinder, said exhaust port being characterized by a throat portion of generally circular cross section aligned with said axis, said throat portion opening into the cylinder and adapted to be closed by the exhaust valve at the cylinder closed end, an exit portion having a floor spaced closely to the throat portion and extending at a sharp angle to the direction of the axis, and a connecting portion smoothly joining the throat and exit portions and including a convexly curved wall portion smoothly connecting said floor with the adjacent part of the throat portion, said connecting and exit portions having a flow guide comprising a free standing bump laterally centered in and narrower than the floor and adjacent curved wall portion, said bump rising in the direction of airflow away from the cylinder smoothly upward from the curved wall portion to a maximum height near its leading edge at the throat and then curving downward in an extended portion smoothly blended with the port floor whereby the central portion of the gas flow in the sharply curved portion of the port is aided in rounding the curve without turbulence, thereby increasing the capacity for flow of exhaust gas through the port.

2. An internal combustion engine including means defining a cylinder closed at one end, an exhaust port communicating with the cylinder through said closed end and a poppet exhaust valve disposed in the port and having head and stem portions reciprocable on an axis for controlling communication of the exhaust port with the cylinder, said exhaust port being characterized by a throat portion of generally circular cross section aligned with said axis, said throat portion opening into the cylinder and adapted to be closed by the exhaust valve at the cylinder closed end, an exit portion having a floor spaced closely to the throat portion and extending at a sharp angle to the direction of the axis, and a connecting portion smoothly joining the throat and exit portions and including a convexly curved wall portion smoothly connecting said floor with the adjacent part of the throat portion, said connecting and exit portions having a flow guide comprising a free standing bump laterally centered in and narrower than the floor and adjacent curved wall portion, said bump rising in the direction of airflow away from the cylinder smoothly upward from the curved wall portion to maximum height near its leading edge at the throat of about one-third the port height and then curving downward in an extended portion smoothly blended with the port floor whereby the central portion of gas flow in the sharply curved portion of the port is aided in rounding the curve without turbulence, thereby increasing the capacity for flow of exhaust gas through the port.

* * * * *